US010808583B2

(12) United States Patent
Pursifull et al.

(10) Patent No.: US 10,808,583 B2
(45) Date of Patent: Oct. 20, 2020

(54) CRANKCASE BREECH DETECTION FOR BOOSTED ENGINES

(71) Applicant: Ford Global Technologies, LLC, Dearborn, MI (US)

(72) Inventors: Ross Dykstra Pursifull, Dearborn, MI (US); Joseph Norman Ulrey, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 684 days.

(21) Appl. No.: 15/384,674

(22) Filed: Dec. 20, 2016

(65) Prior Publication Data

US 2017/0101912 A1 Apr. 13, 2017

Related U.S. Application Data

(62) Division of application No. 14/565,358, filed on Dec. 9, 2014, now Pat. No. 9,523,298, which is a division (Continued)

(51) Int. Cl.
*F01M 13/00* (2006.01)
*F01M 13/02* (2006.01)
(Continued)

(52) U.S. Cl.
CPC ..... *F01M 13/0011* (2013.01); *F01M 1/16* (2013.01); *F01M 1/18* (2013.01); (Continued)

(58) Field of Classification Search
CPC .. F01M 1/16; F01M 1/18; F01M 1/20; F01M 13/00; F01M 13/0011; F01M 13/028; (Continued)

(56) References Cited

U.S. PATENT DOCUMENTS 2,539,604 A 1/1951 Woolley
2,660,058 A 11/1953 Vogt
(Continued)

OTHER PUBLICATIONS

Vacuum Pump Exhausting Crankcase, Prior Art.

*Primary Examiner* — Grant Moubry
(74) *Attorney, Agent, or Firm* — Geoffrey Brumbaugh; McCoy Russell LLP

(57) ABSTRACT

Methods for indicating whether a crankcase of an engine is breeched are provided. One example method comprises restricting a communication of the crankcase with atmosphere, acting to increase or decrease a crankcase pressure, and indicating whether the crankcase is breeched based on the crankcase pressure. Another example method comprises sensing a crankcase pressure component, and indicating whether the crankcase is breeched based on the crankcase pressure component, the crankcase communicating with atmosphere via a conduit, a restrictedness of the conduit responsive to one or more of a crankcase pressure and a signal from an electronic control unit of the motor vehicle. Still other examples provide more particular methods for indicating whether the crankcase is breeched, and example configurations that enable the various methods.

13 Claims, 5 Drawing Sheets

Related U.S. Application Data of application No. 12/334,386, filed on Dec. 12, 2008, now abandoned.

(51) Int. Cl.
*F01M 1/18* (2006.01)
*F01M 1/16* (2006.01)
*F02B 33/00* (2006.01)

(52) U.S. Cl.
CPC ..... *F01M 13/00* (2013.01); *F01M 13/028* (2013.01); *F02B 33/00* (2013.01); *F01M 2013/0038* (2013.01); *F01M 2013/0077* (2013.01); *F01M 2013/0083* (2013.01)

(58) Field of Classification Search
CPC ... F01M 2013/0083; F01M 2013/0077; F01M 2013/0038; F02B 33/00; F02M 35/10222
See application file for complete search history.

(56) References Cited

U.S. PATENT DOCUMENTS

| | | | | |
|---|---|---|---|---|
| 3,460,181 | A | 8/1969 | Denver | |
| 4,191,211 | A | 3/1980 | Walker | |
| 4,401,093 | A | 8/1983 | Gates, Jr. et al. | |
| 4,800,931 | A | 1/1989 | Petkovsek | |
| 5,219,398 | A * | 6/1993 | Nonaka | F02B 61/045 123/406.47 |
| 5,660,206 | A | 8/1997 | Neal et al. | |
| 6,018,882 | A | 2/2000 | Brousseau | |
| 6,098,603 | A * | 8/2000 | Maegawa | F01M 13/023 123/198 D |
| 6,779,388 | B2 | 8/2004 | Baeuerle et al. | |
| 6,779,516 | B1 * | 8/2004 | Shureb | F01M 1/18 123/572 |
| 7,360,319 | B1 | 4/2008 | Goldstein et al. | |
| 7,562,559 | B2 | 7/2009 | Chung et al. | |

* cited by examiner

CRANKCASE BREECH DETECTION FOR BOOSTED ENGINES

CROSS REFERENCE TO RELATED APPLICATIONS

The present application is a divisional of U.S. patent application Ser. No. 14/565,358, entitled "CRANKCASE BREECH DETECTION FOR BOOSTED ENGINES," filed on Dec. 9, 2014, now U.S. Pat. No. 9,523,298. U.S. patent application Ser. No. 14/565,358 is a divisional of U.S. patent application Ser. No. 12/334,386, entitled "CRANKCASE BREECH DETECTION FOR BOOSTED ENGINES," filed on Dec. 12, 2008. The entire contents of the above referenced applications are hereby incorporated by reference in their entirety for all purposes.

TECHNICAL FIELD

The present application relates to the field of motor-vehicle engine systems and more particularly to maintenance of engine lubricant in turbocharged or supercharged motor-vehicle engine systems.

BACKGROUND AND SUMMARY

Relative to a naturally aspirated engine of similar output power, a turbocharged or supercharged engine may exhibit a prolonged duty cycle and increased blow-by (i.e., pressurized combustion gas entering the crankcase via the piston rings). Therefore, specialized engine components and/or configurations may be provided for proper maintenance of the engine lubricant. For example, a positive crankcase ventilation (PCV) system of a turbocharged or supercharged engine may include one or more enhanced air/lubricant separators to limit loss of engine lubricant to the intake during high-load operation.

The prolonged duty cycle and increased blow-by in a turbocharged or supercharged engine may cause engine lubricant to aspirated rapidly through any breech of the crankcase—through an uncapped lubricant filling port or unseated dipstick, for example. In some cases, an unacceptable loss of engine lubricant may occur in just a few hours of high-load operation when a dipstick is left unseated. If the loss of engine lubricant goes undetected, significant engine damage may result.

The inventors herein have recognized the disadvantages noted above and have provided a series of approaches to address them. One embodiment provides a method for indicating whether a crankcase of an engine is breeched, the engine having a crankcase ventilation system (positive, road draft, or foul air). This example method comprises restricting a communication of the crankcase with atmosphere, acting to increase or decrease a crankcase pressure, and indicating whether the crankcase is breeched based on the crankcase pressure. Another example method comprises sensing a crankcase pressure component, and indicating whether the crankcase is breeched based on the crankcase pressure component, the crankcase communicating with atmosphere via a conduit, a restrictedness of the conduit responsive to one or more of a crankcase pressure and a signal from an electronic control unit of the motor vehicle. Still other embodiments provide more particular methods for indicating whether the crankcase is breeched, and example configurations that enable the various methods. The approaches described herein provide reliable detection of a breeched crankcase in boosted engines, thereby avoiding excessive lubricant loss and prolonging engine life.

It will be understood that the summary above is provided to introduce in simplified form a selection of concepts that are further described in the Detailed Description. It is not meant to identify key or essential features of the claimed subject matter, the scope of which is defined by the claims that follow the Detailed Description. Further, the claimed subject matter is not limited to implementations that solve any disadvantages noted above or in any part of this disclosure.

DETAILED DESCRIPTION

Figure 1:
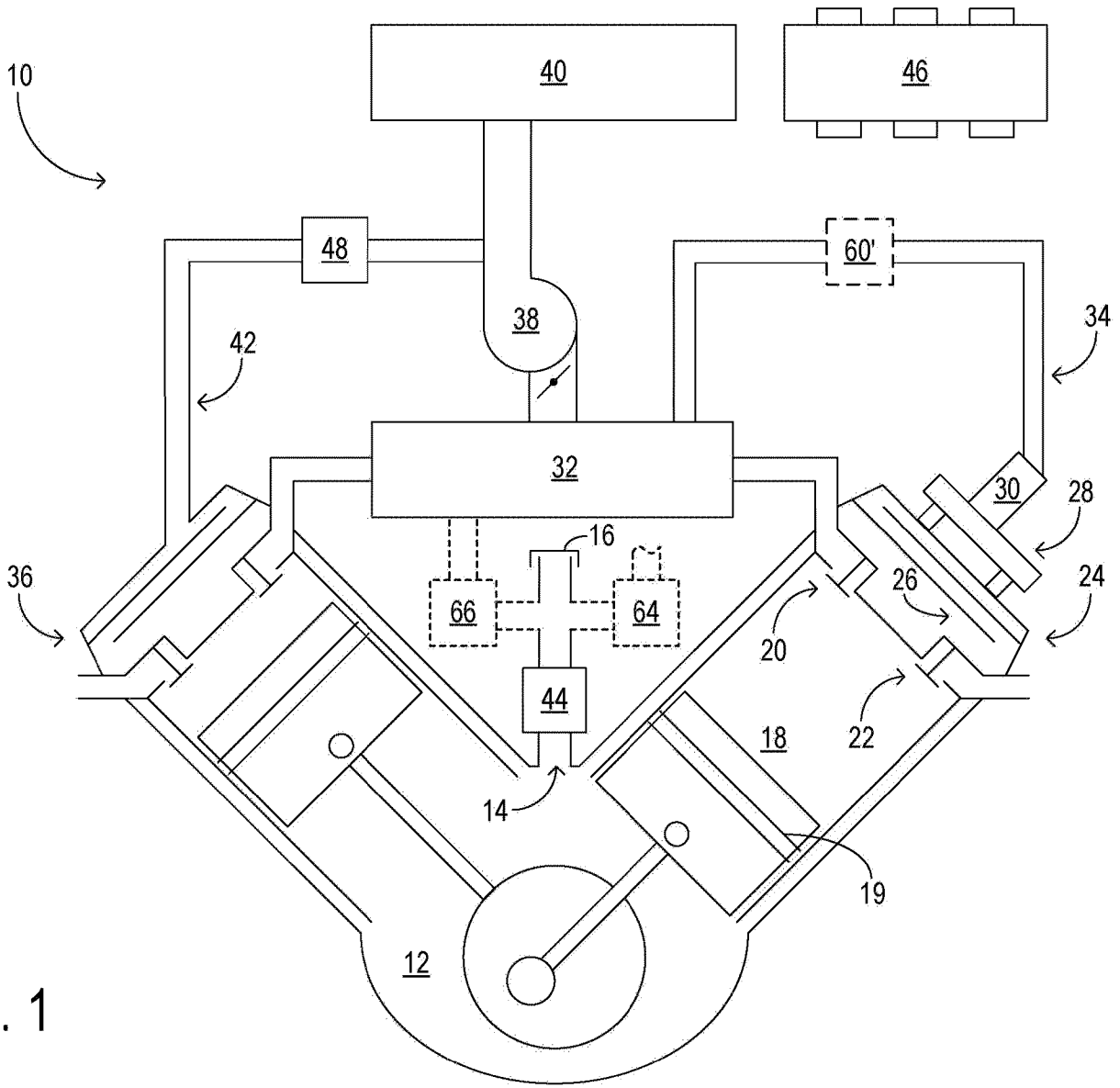
FIG. 1 shows an example turbocharged engine in accordance with the present disclosure.

FIG. 1 shows example engine 10 in schematic detail. The drawing schematically shows a V-type engine, but other configurations are contemplated as well. The engine includes crankcase 12, which contains crankcase head gas and engine lubricant. In some embodiments, the crankcase may include one or more access ports for checking and/or correcting the level of the engine lubricant. FIG. 1 shows access port 14, which is isolated from the atmosphere via closure 16. The closure may be a cap, e.g., a screw cap or snap cap. In some embodiments, the closure may include a dipstick for checking the level of the engine lubricant. In these and other embodiments, the closure may include a pressure-relief valve configured to discharge crankcase head gas to the atmosphere when the pressure of the crankcase head gas exceeds a threshold.

FIG. 1 shows cylinder 18 coupled to intake valve 20 and to exhaust valve 22; both valves are disposed below right valve cover 24. Internal lubricant separator 26 is also disposed below the right valve cover, and external lubricant separator 28 is disposed above the right valve cover.

FIG. 1 shows a piston within cylinder 18, and piston rings 19 configured to isolate the combustion gasses inside cylinder from crankcase 12. Nevertheless, combustion gasses may 'blow by' the piston rings at some rate, and accumulate in the crankcase. Therefore, a crankcase ventilation system (e.g., a PCV system) is provided. Thus, PCV valve 30 is shown in FIG. 1, coupled to the external lubricant separator and configured to admit crankcase head gas to intake manifold 32 via PCV-inlet tube 34.

Intake manifold 32 may communicate with a plurality of cylinders equivalent to cylinder 18 via a plurality of intake valves. For ease of illustration, however, only one other cylinder is shown in FIG. 1; left valve cover 36 is shown disposed over the other cylinder. As shown in the drawing, the left and right valve covers may be disposed over cylinders on substantially opposite sides of engine 10.

Intake manifold 32 may communicate with a plurality of cylinders equivalent to cylinder 18 via a plurality of intake valves. For ease of illustration, however, only one other cylinder is shown in FIG. 1; left valve cover 36 is shown disposed over the other cylinder. As shown in the drawing, the left and right valve covers may be disposed over cylinders on substantially opposite sides of engine 10.

When engine 10 is moderately loaded, lightly loaded, or idling, crankcase head gas is suctioned into intake manifold 32 through PCV valve 30. Fresh air from air cleaner 40 flows into the crankcase via left valve cover 36. This condition, called 'clean-air purge,' occurs when the crankcase is at lower pressure than the turbocharger inlet. However, when the crankcase is at higher pressure than the turbocharger inlet, crankcase head gas flows up breather tube 42 and enters the intake through the turbocharger; this condition—called 'push-over'—may occur when the engine is more highly loaded.

Continuing in FIG. 1, engine 10 includes pressure sensor 44 configured to sense a pressure of the head gas in crankcase 12. The pressure sensor may be configured to generate an output (e.g., an output voltage) responsive to a pressure of the head gas. Although the pressure sensor is shown coupled to access port 14 and disposed between closure 16 and crankcase 12, it may be coupled to the crankcase at various other locations instead. In some embodiments, the pressure sensor may be configured to sense one or more particular components of the crankcase pressure—a steady-state pressure, a low-pass filtered pressure, one or more Fourier components of the pressure, a component locked in phase with an operating condition of the engine, etc. In other embodiments, the pressure sensor may be a pressure-activated switch, for example.

Pressure sensor 44 may be operatively coupled to controller 46, which may be any electronic control unit of the motor vehicle. In some embodiments, the same conductors that supply a heating current to PCV valve 30 may conduct the output voltage of the pressure sensor back to the controller. Thus, existing conductors may be used to provide operative coupling between the sensor and the controller. Controller 46 may be operatively coupled to other engine and/or motor-vehicle components as well—to switchable pressure/vacuum sources, controllable valves, indicators, alarms, and diagnostic systems, as examples. In the various embodiments disclosed herein, the controller may be configured to sample an output of the pressure sensor and to indicate whether the crankcase is breeched based on the output. In some embodiments, the same pressure sensor may be configured to report the pressure of the crankcase head gas as well as the external barometric pressure, for the controller may be configured to identify conditions where the two pressures are equal or otherwise relatable to each other.

The embodiments illustrated in FIG. 1 enable various methods to detect an unexpected breech of crankcase 12, which may occur, for instance, if closure 16 is defective or is left open by mistake. It will be understood, however, that a crankcase may be breeched in various other ways as well—via a leaky sealing element fluidically coupled to the crankcase (leaky piston rings, a leaky PCV valve, for example). In general, unexpected communication between a crankcase of an engine and the environment exterior the crankcase may be identified to constitute a crankcase breech; it is contemplated that crankcase breeches of various kinds may be detected and indicated via the systems and methods described herein, although with some variation depending on the type of breech being monitored.

Some of the methods presently disclosed rely on one or more dedicated flow-control components (valves, conduits, etc.) disposed in the PCV system of engine 10, or elsewhere in the motor vehicle. In some embodiments, the one or more flow-control components located in breather tube 42 may present a restrictedness in the breather tube that is responsive to the crankcase pressure and/or a signal from the electronic control unit. For example, a check valve located in the breather tube may present a restrictedness responsive to a crankcase pressure, while a controllable valve located in the breather tube may present a restrictedness responsive to controller 46.

Figure 2:
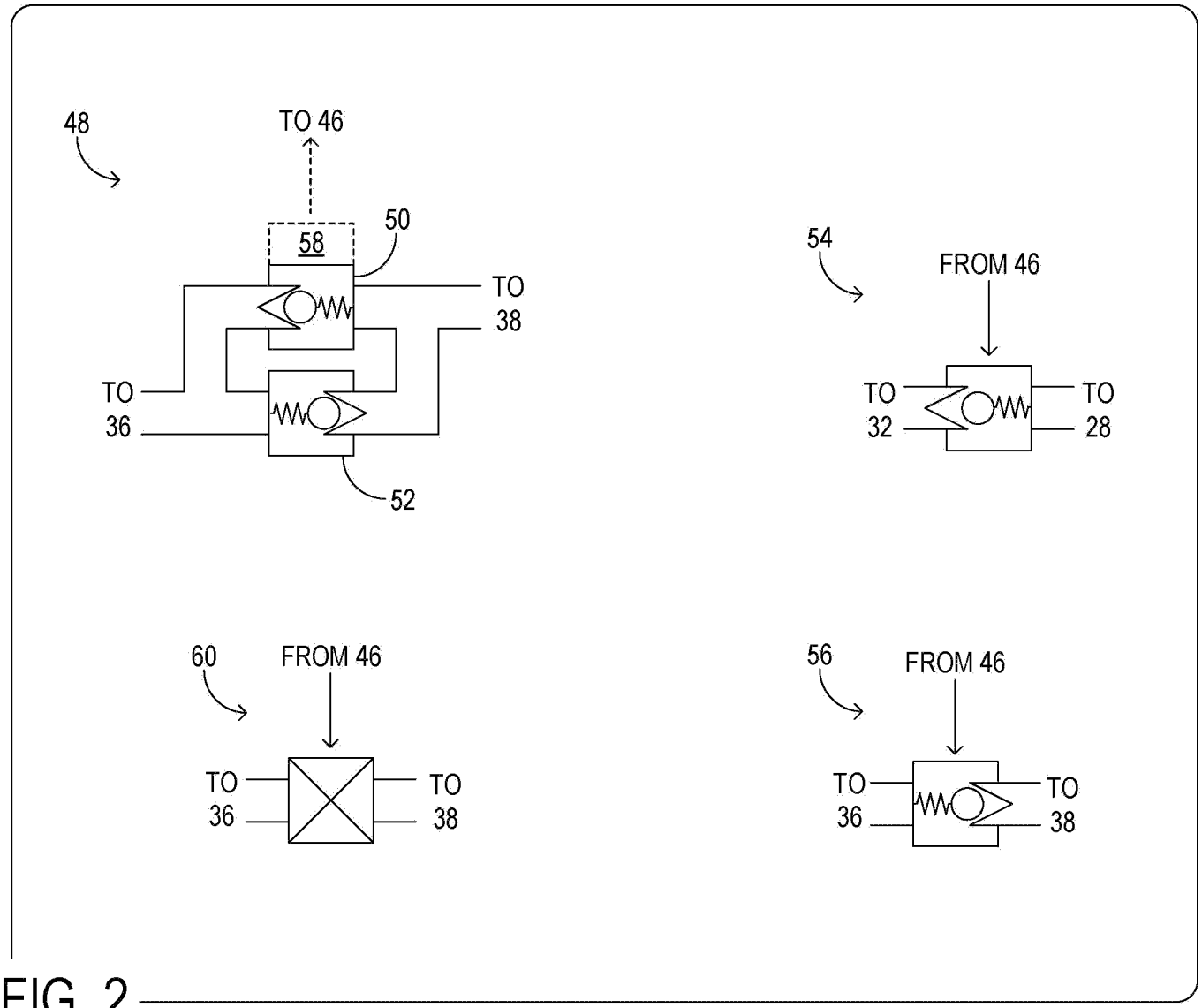
FIG. 2 shows various example flow-control components of an example turbocharged engine, in accordance with the present disclosure.

Various flow-control embodiments are described presently by way of example, and some are illustrated schematically in FIG. 2. It will be understood that not all of the components presently described are necessary to enable crankcase breech detection in any given engine system. The flow-control components to be included will depend on the particular method or methods of breech detection enacted by the system.

FIG. 1 shows breather valve 48 disposed in breather tube 42. In a first flow control embodiment, the breather valve (shown also in FIG. 2) includes two check valves (e.g., one-way pressure-activated valves) disposed in parallel, with the inlet of first check valve 50 coupled to left valve cover 36, and the inlet of second check valve 52 coupled to the low-pressure side of turbocharger 38. This orientation routes the breather flow through a different check valve depending on whether the flow is towards the left valve cover (during clean-air purge) or towards the air cleaner (during push-over). One or both of the check valves may present a small but significant restriction to the breather flow. This aspect may be advantageous for detecting a breech of crankcase 12. For example, restricting the flow of air to the left valve cover may cause the crankcase, if unbreeched, to develop a vacuum during clean-air purge. Likewise, restricting the flow of crankcase head gas to the turbocharger inlet may cause the crankcase to develop a positive pressure during push-over. Moreover, a restriction to breather flow in either direction will lessen the degree to which fluctuations in the pressure of the crankcase head gas are vented to the atmosphere, resulting in better accuracy for methods that rely on sensing such fluctuations (vide infra).

In a second flow-control embodiment, breather valve 48 includes two opposing check valves as in the first flow-control embodiment. In addition, an electronically actuable PCV valve 54 is used in place of PCV valve 30. The electronically actuable PCV valve is operatively coupled to controller 46 and may be triggered by the controller to open wide at idle (contrary to the usual operation of a PCV valve). By opening wide at idle, the electronically actuable PCV valve may draw a large flow, causing crankcase 12, if unbreeched, to develop a vacuum. If the crankcase fail to develop an expected level of vacuum under such conditions, a breech of the crankcase may be indicated.

In a third flow-control embodiment, breather valve 48 includes two opposing check valves as in the first flow-control embodiment. But here, the first check valve 50 is replaced by electronically actuable check valve 56. Coupled to controller 46, the electronically actuable check valve may be normally open to flow in the indicated direction; closing it cuts off a supply of air to left valve cover 36, which may cause the crankcase, if unbreeched, to develop a vacuum during clean-air purge. If the crankcase fail to develop an expected level vacuum under such conditions, a breech of the crankcase may be indicated.

In a fourth flow-control embodiment—the converse of the third embodiment—breather valve 48 includes two opposing check valves as in the first flow-control embodiment. But here, second check valve 52 is replaced by electronically actuable check valve 56. Closing this valve cuts off the flow of crankcase head gas to the inlet of turbocharger 38, which may cause the crankcase, if unbreeched, to develop a positive pressure during push-over conditions. If the crankcase fail to develop an expected positive pressure under such conditions, a breech of the crankcase may be indicated.

In a fifth flow-control embodiment, breather valve 48 includes two opposing check valves, as in the first flow-control embodiment. But here, first check valve 50 is coupled to pulsation sensor 58. The pulsation sensor is operatively coupled to controller 46, which is configured to correlate the amplitude of the pulsation with the integrity of crankcase 12, viz., a pulsation of lower amplitude than expected may indicate that the crankcase is breeched.

In a sixth flow-control embodiment, breather valve 48 includes an electronically actuable, normally-open valve 60 disposed between left valve cover 36 and the low-pressure side of turbocharger 38. The normally open valve may operatively coupled to controller 46 and configured to close in response to a signal from the controller. Closure of the valve during clean air flow may cause vacuum to develop in the crankcase, if the crankcase is unbreeched. Closure of the valve during push-over conditions may cause pressure to develop in the crankcase if the crankcase is unbreeched. If the crankcase fail to develop the expected level of vacuum or pressure, a breech of the crankcase may be indicated.

In a seventh flow-control embodiment, breather valve 48 includes one electronically actuable, normally open valve 60, as described in the previous embodiment. In addition, a second electronically actuable, normally open valve 60' is provided in PCV-inlet tube 34. During normal operation of the vehicle, both valves may remain open to permit the PCV system to function normally. Pursuant to a signal from controller 46, however, the valves may close to temporarily isolate crankcase 12 from the PCV system of engine 10. If the isolated crankcase is unbreeched, the pressure within it may increase due to blow-by, heating from the engine, etc. If the pressure in the crankcase fail to increase as expected, a breech of the crankcase may be indicated.

Returning now to FIG. 1, an eighth flow-control embodiment is illustrated, wherein one or more access ports of crankcase 12 (the same or different than those referred to above) may couple the crankcase to switchable pressure/vacuum port 64. The switchable pressure/vacuum port may comprise a controllable pump, or in other embodiments, a controllable valve via which access port 14 may be switchably linked to a source of pressure or vacuum. The source of pressure or vacuum may be actively driven by engine 10; it may be a turbocharger or intake manifold of the engine, for example. In other embodiments, the source of pressure or vacuum may derive from a changing temperature in one or more motor-vehicle cavities. In one embodiment, the switchable pressure/vacuum port may communicate with an engine-off natural vacuum (EONV) source; it may be operable, therefore, even when the engine is turned off.

Switchable pressure/vacuum port 64 may be operatively coupled to controller 46, and used in a closed-loop manner to actively regulate the pressure of the crankcase head gas. In this example, an inability of the controller to regulate to the desired pressure, or an unexpected change in the control input needed to provide the regulation, may indicate a breech of crankcase 12.

In another example, switchable pressure/vacuum port 64 may be configured to provide an initial level of vacuum or pressurization in crankcase 12 by initially coupling the crankcase to a pressure or vacuum source. The switchable pressure/vacuum port may then be switched off, isolating the crankcase from the pressure or vacuum source and allowing the initial level to approach atmospheric pressure. Controller 46 may be configured to monitor an output of pressure sensor 44 during the approach and to correlate crankcase integrity with some property of the approach, e.g., a decay time constant or similar metric.

Continuing in FIG. 1, a ninth flow-control embodiment is illustrated, wherein one or more access ports of crankcase 12 (the same or different than those referred to above) may provide auxiliary coupling to intake manifold 32 via PCV-bypass valve 66. The PCV-bypass valve may be an electronically actuable, normally open valve operatively coupled to controller 46. The controller may be configured to open the PCV-bypass valve during engine cranking. Under such conditions, with the intake throttle closed and the crankcase isolated (as in the seventh flow-control embodiment, for example), crankcase 12, if unbreeched, will develop a vacuum. If the crankcase fail to develop an expected level of vacuum under these conditions, a breech of the crankcase may be indicated.

In some embodiments, the same conductors that supply a heating current to PCV valve 30 may carry the actuating signal from controller 46 to one or more electronically controlled valves. Thus, existing conductors may be used to provide operative coupling between the sensor and the controller, and in some examples, a multiplexing scheme may be used.

Figure 3:
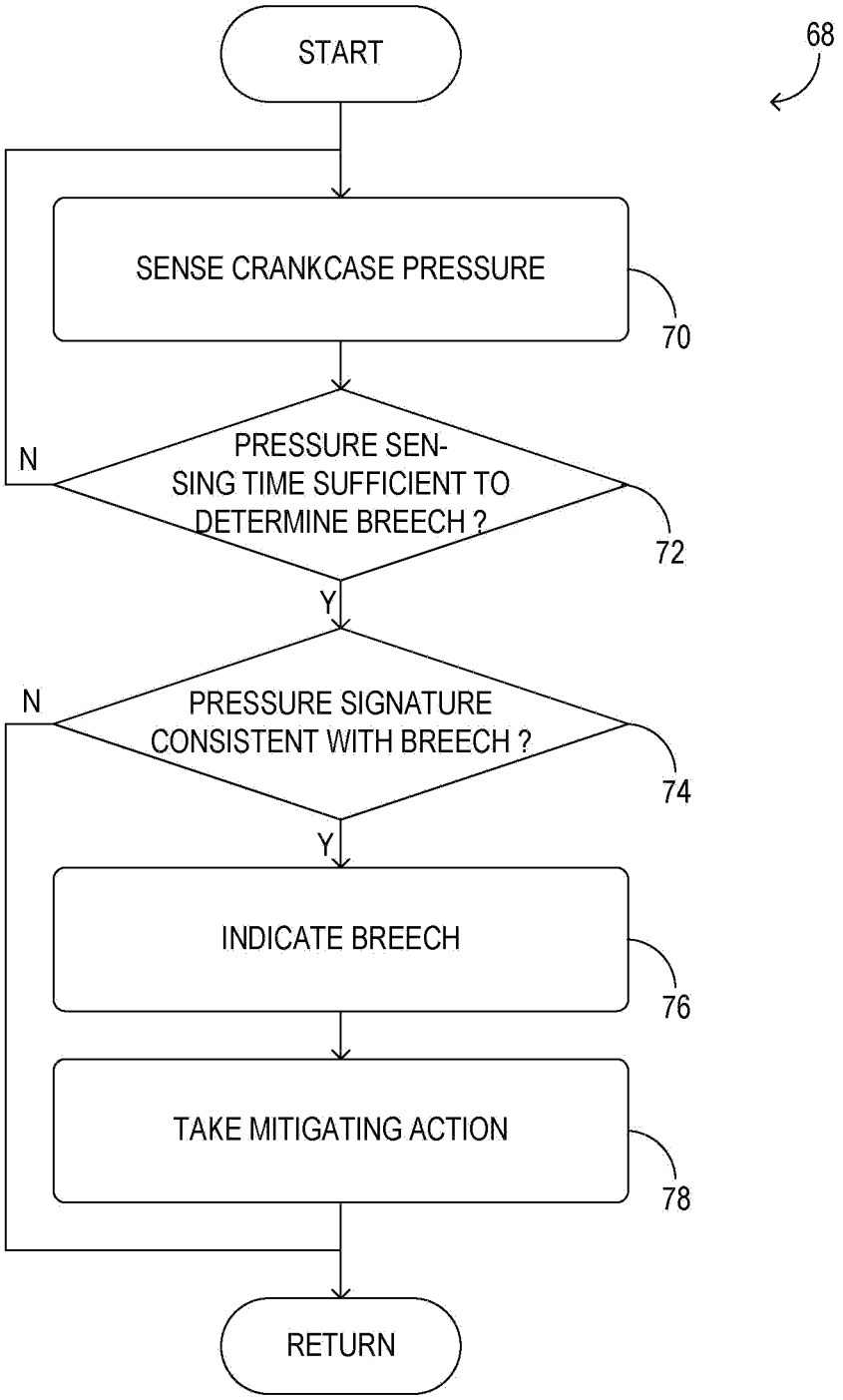
FIG. 3 shows a first example method for determining when a crankcase of a turbocharged engine is breeched, in accordance with the present disclosure.

FIG. 3 illustrates a first example method 68 to detect a breech of a crankcase in a motor vehicle. Though presently described with continued reference to aspects of FIG. 1, method 68 may be enabled by various other configurations as well.

Method 68 begins at 70, where a pressure of the crankcase head gas is sensed via a sensor and received at an electronic control unit of the motor-vehicle. The sensor may be a crankcase pressure sensor such as pressure sensor 44 or a pulsation sensor such as pulsation sensor 58. At 72, it is determined whether sufficient time has been provided for the electronic control unit to determine whether the crankcase is breeched. If it is determined that sufficient time has not been provided, then execution resumes at 70, where pressure sensing continues. Otherwise, execution proceeds to 74, where it is determined whether a pressure signature received by the electronic control unit is consistent with the crankcase being breeched.

When crankcase 12 is unbreeched, the pressure signature that is received at the electronic control unit may comprise a train of pulsations or oscillations that correlate with an operational state of one or more cylinders of engine 10 and/or an operational state of turbocharger 38. The train of pulsations or oscillations may be separable from a substantially steady-state pressure of the crankcase head gas via appropriate electronics, algorithms, etc., and may by expressible as an alternating component of the crankcase head pressure superposed over the substantially steady-state pressure. Further, in embodiments as illustrated in FIG. 1, wherein breather valve 48 provides a restriction in breather tube 42, the pressure signature of an unbreeched crankcase may retain a greater amplitude, because of less facile venting to the atmosphere.

Therefore, in embodiments where a check valve is disposed in the breather tube, and where the output of the sensor includes an alternating output, the controller may be further configured to indicate the crankcase breeched if the alternating output more closely matches an output expected for a breeched crankcase than an output expected for an unbreeched crankcase. In one particular example, an amplitude of the alternating component of the crankcase head pressure may be correlated to crankcase integrity. In this example, the crankcase may be indicated breeched if the amplitude of the alternating component drops below a threshold value. Further, the threshold value may depend on an operating parameter of the engine and/or the characteristics of one or more flow-control elements provided in the PCV system.

In other examples, one or more sub-components of the alternating component may be correlated to crankcase integrity—a sub-component phase-locked to an operational state of a cylinder of the engine, for example. An appropriately phase-locked component may be provided in a variety of different ways, including, in one example, by synchronizing a sampling of the crankcase head gas pressure from the sensor to an operational state of cylinder 18.

If it is determined that the pressure signature is consistent with the crankcase being breeched, then at 76, the breech is indicated via the electronic control unit. A crankcase breech may be indicated in various ways: by illuminating a dashboard indicator, by sounding an alarm, by setting a dedicated MIL flag or other diagnostic code in an on-board diagnostic system of the motor vehicle, for example.

The pressure signature evaluated at 74 may admit of a more detailed indication than whether or not the crankcase is breeched. For example, the pressure signature may be used to detect whether the crankcase has a relatively large breech, such as may be caused by an oil cap being left off or a dipstick being unseated. In this example, the pressure signature may not enable detection of a much smaller breech, such as may be caused by leaky piston rings or a leaky PCV valve, for example. In other examples, it may be possible to detect both large and small breeches, and to discriminate between them based on the pressure signature. Likewise, the rate of change of a size of a detected breech may be indicative of a type of breech. For example, an oil cap off condition may result in a relatively rapid change in the detected breech, whereas degradation of piston rings may results in a relatively slow, in comparison, change in the detected breech. As such, the systems and methods here may further discriminate in the type of breech based on such information.

At 78, a mitigating action is initiated by the electronic control unit of the motor vehicle. The mitigating action may include acting to delay a depletion of lubricant from the crankcase if the crankcase is indicated breeched. In particular, the mitigating action may include reducing an intake of air into the engine, limiting a speed or torque of engine 10, limiting a fuel injection amount supplied to the engine, limiting a throttle opening, disabling turbocharger 38, and/or various other actions intended to limit an aspiration of engine lubricant from breeched crankcase 12. In some embodiments, the mitigating action taken at 78 may be one of a plurality of mitigating actions taken when a crankcase breech is detected. In one example, the plurality of mitigating actions may include adding lubricant to the crankcase—pumping lubricant from an auxiliary reservoir and into the crankcase, for example. After 78, or if it is determined that the pressure signature is not consistent with the crankcase being breeched, method 68 returns. For increased reliability of method 68, it may be advantageous to limit execution of the method to a predetermined set of operating conditions of the engine, e.g., idle, a fixed range of engine speeds, etc.

Figure 4:
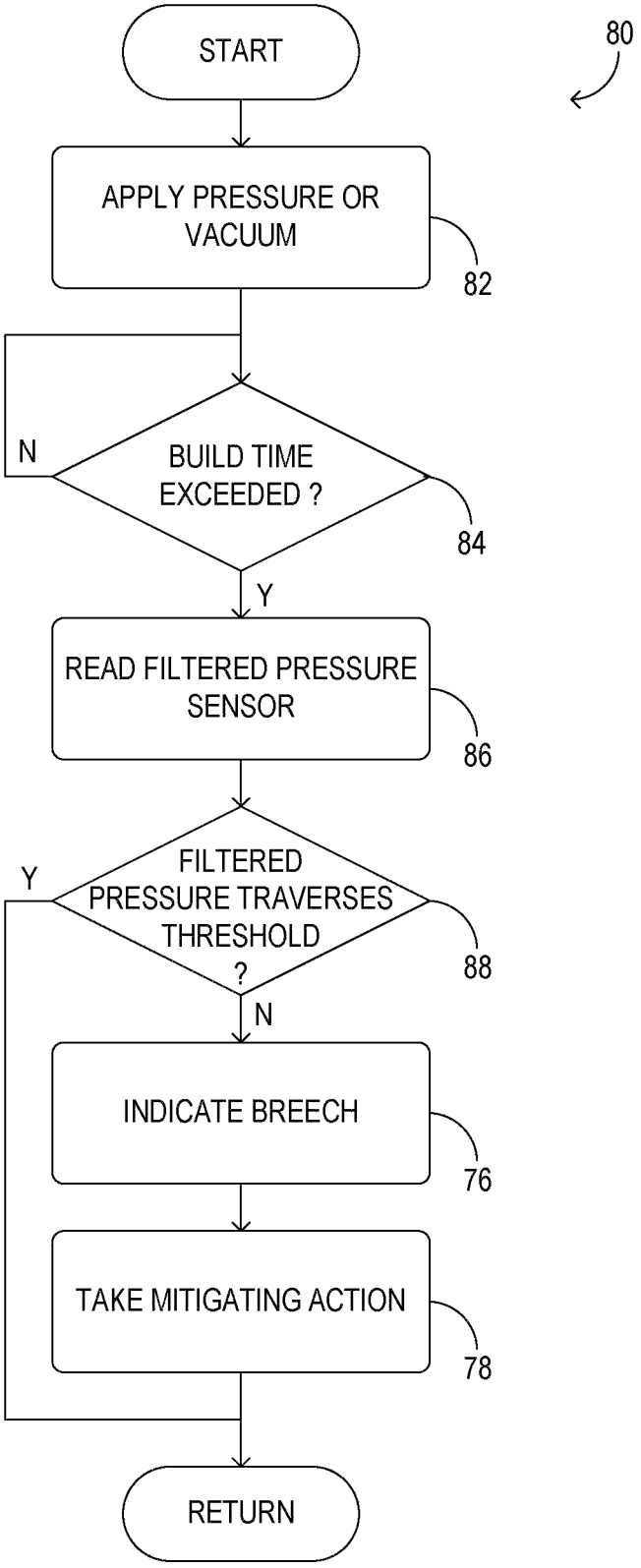
FIG. 4 shows a second example method for determining when a crankcase of a turbocharged engine is breeched, in accordance with the present disclosure.

FIG. 4 illustrates a second example method 80 to detect a breech of a crankcase in a motor vehicle. Process steps in this and subsequent embodiments that are substantially the same as described in a previous embodiment are labeled in the same way, and are described no further. It will be understood, however, that equivalently labeled steps may differ to some degree in the different embodiments of this disclosure. And, while presently described with continued reference to aspects of FIG. 1, method 80 may be enabled by various other configurations as well.

Method 80 begins at 82, where an action is taken to increase or decrease the crankcase pressure. The action may be taken in any number of ways, depending on the particular configuration of the engine and the motor vehicle in which the method is enacted. In subsequent steps of the method, the crankcase may be indicated breeched based if, on acting to increase or decrease a crankcase pressure, the crankcase pressure fails to respond as expected.

In embodiments where the engine includes a PCV system, acting to increase or decrease a crankcase pressure may include influencing the PCV system to cause a net flow of gas into or out of the crankcase. For example, in particular configurations where breather valve 48 includes an electronically actuable check valve or an electronically actuable normally open valve, pressure may be applied by closing off the valve during push-over, or, vacuum may be applied by closing off the valve during clean-air purge. Thus, method 80 may include restricting a communication of the crankcase with atmosphere by closing one or more electronically actuable valves. In another embodiment, where the engine includes an electronically actuable breather valve 48 and PCV-inlet valve 60', pressure may be applied to the crankcase by closing both of these valves. Thus, method 80 may further include restricting a communication of the crankcase with an intake of the engine.

In other embodiments, where the engine includes an electronically actuable PCV valve, vacuum may be applied by opening wide the electronically actuable PCV valve during idle. In another embodiment, where breather valve 48 is configured like an EGR injector valve, vacuum may be applied to the crankcase by opening the valve during high-flow conditions. In another embodiment, where the engine includes a switchable pressure/vacuum source such as switchable pressure/vacuum source 64, pressure or vacuum may be applied by switching on the switchable pressure/vacuum source. In this manner, acting to increase the crankcase pressure may comprise selectably coupling the crankcase to a source of pressure, and, acting to decrease the crankcase pressure may comprise selectably coupling the crankcase to a source of vacuum. In still another embodiment, where the engine includes a PCV by-pass valve 66, vacuum may be applied by opening the PCV by-pass valve during engine cranking, with the intake throttle closed and the crankcase isolated (via electronically actuable valves in breather tube 42 and PCV-inlet tube 34, for example).

Method 80 then continues to 84, where it is determined whether the time since acting to increase or decrease the crankcase pressure exceeds a pre-determined build time. The build time may be any suitable time interval over which the pressure of the crankcase head gas would significantly change were the crankcase isolated from the atmosphere and subject to the application of pressure or vacuum. The build-time may be a function of various engine parameters (displacement, for example), and on the manner of application of pressure/vacuum. The build-time may be 2 seconds or 5 seconds, in some examples. If the build time has not been exceeded, then the method loops back to 84; otherwise, the method continues to 86.

At 86, a filtered pressure of the crankcase head gas is read at the controller. In some embodiments, the controller may read a filtered pressure from a pressure sensor, such as pressure sensor 44. The filtered pressure may be the substantially steady state pressure referred to hereinabove. The filtered pressure may be the result of low-pass filtering (analog filtering, digital filtering, Fourier filtering, etc.) of the output voltage of the pressure sensor. The filtering may be enacted at the pressure sensor, or in other embodiments, at controller 46, to which the pressure sensor is operatively coupled.

If the pressure of the crankcase head gas fails to increase as expected when pressure is applied to the crankcase, or, fails to decrease as expected when vacuum is applied to the crankcase, then the crankcase may be indicated breeched. Therefore, at 88, it is determined whether the filtered pressure traverses a pre-determined threshold (exceeds the threshold in embodiments where a pressure is applied to the crankcase, or drops below the threshold in embodiments where a vacuum is applied to the crankcase). The threshold may be a function of various engine parameters (displacement, compression, coolant temperature, etc.). The threshold may be 2 or 5 pounds per square inch, in some examples. Thus, the crankcase may be indicated breeched if the crankcase pressure stays below a threshold, or in other examples, stays above a threshold. However, if it is determined that the threshold has been traversed in the expected manner, then the method returns; otherwise, the method continues to 76, and then to 78.

In other embodiments fully consistent with this disclosure, there may be a plurality of pressure thresholds that are traversed depending on the nature of the crankcase breech. For example, there may be a first threshold corresponding to a relatively large crankcase breech, such as may result from an oil cap being left off or a dipstick being left unseated. In this or other embodiments, there may be a second threshold corresponding to a smaller crankcase breech, such as may result from leaky piston rings or a leaky PCV valve, for example. Accordingly, methods to detect crankcase breech may comprise comparing an output of the pressure sensor to one or more different thresholds and determining which, if any, are traversed. In this manner, the method may indicate or extrapolate the manner in which the crankcase is breeched.

It is further contemplated that the output of the pressure sensor may be compared against the first threshold at one point in the diagnostic procedure, and against the second threshold at another point, later in the diagnostic procedure. Thus, a first diagnosis may be applied according to the methods set forth above to establish that the crankcase is not severely breeched (as a result of an oil cap being left off, etc.). Then, if it is determined that the crankcase is not severely breeched, action may be taken to increase or decrease the crankcase pressure, and a relatively smaller breech may be diagnosed by monitoring the resulting pressure change, again as set forth above.

Figure 5:
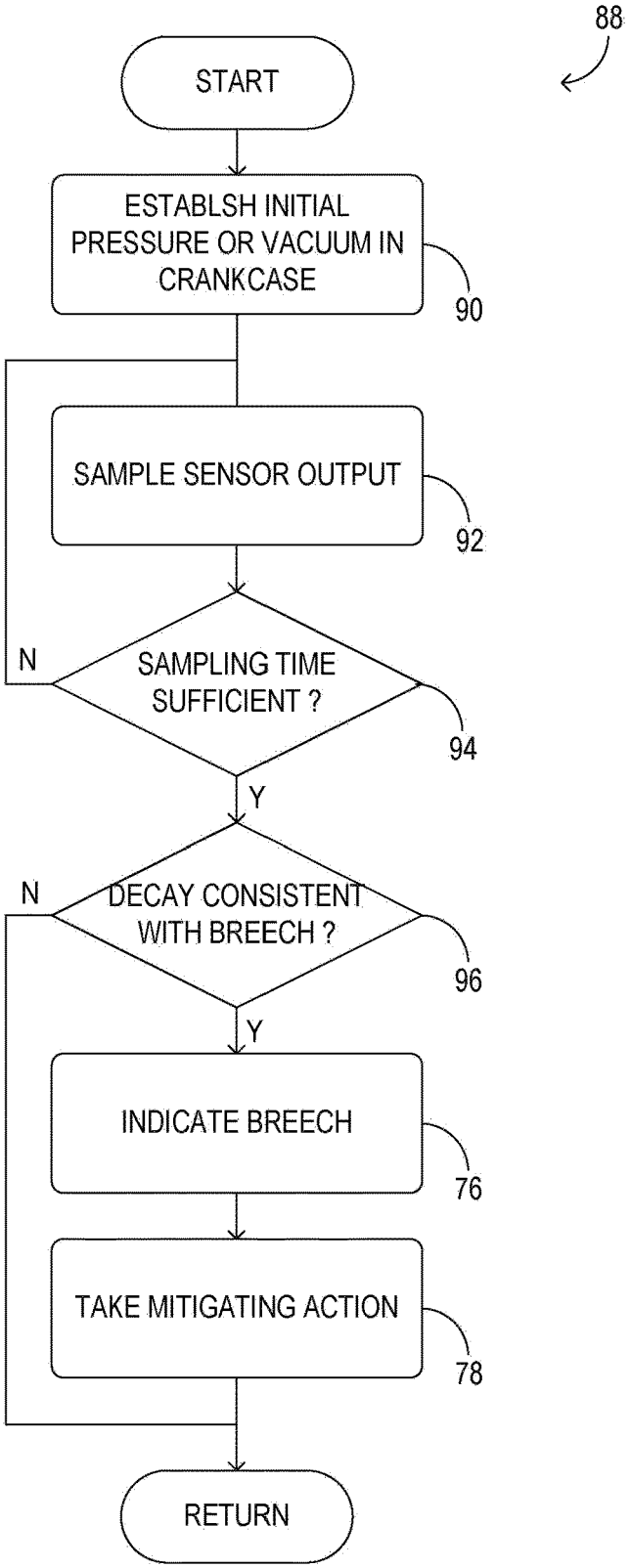
FIG. 5 shows a third example method for determining when a crankcase of a turbocharged engine is breeched, in accordance with the present disclosure.

FIG. 5 illustrates a third example method 88 to detect a breech of a crankcase in a motor vehicle. While presently described with continued reference to aspects of FIG. 1, method 88 may be enabled by various other configurations as well.

Method 88 begins at 90, where an initial level of pressure or vacuum is established in the crankcase. The initial level of pressure or vacuum may be established in a variety of different ways, depending on the particular configuration of the engine and the motor vehicle in which the method is enacted. The description of process step 82 of method 80 gives examples of ways of applying pressure or vacuum to the crankcase; an initial level of pressure or vacuum may be established in the same manner. In some embodiments, however, a closed loop procedure may be used, wherein pressure or vacuum is applied to the extent necessary to elicit a pre-determined response from the sensor. In this manner, the initial level of pressure or vacuum may be established. After establishing the initial level of pressure or vacuum, the application of pressure or vacuum may be discontinued. In some embodiments, the crankcase may be isolated from the source of the pressure or vacuum, as with a controllable valve, when the application of pressure or vacuum is discontinued.

In some embodiments, process step 90 may commence when the motor vehicle is turned off. Such embodiments may be particularly suited to the use of an EONV source to establish an initial level of vacuum. In other embodiments, process step 90 may commence while the engine is running and while the motor vehicle is in operation.

At 92, an output of the pressure sensor is sampled by an electronic control unit of the motor vehicle. In some embodiments, the sampled output of the sensor may be recorded by the electronic control unit at regularly spaced time intervals. In this manner, a profile of the decay of initial level of pressure or vacuum may be accumulated.

At 94, it is determined whether the time over which the output of the pressure sensor has been sampled is sufficient to allow the electronic control unit to assess crankcase integrity. If it is determined that the sampling time is not yet sufficient, then the method loops back to 92, where sampling is continued. Otherwise, the method continues to 96.

At 96, the electronic control unit determines whether the decay profile is consistent with the crankcase being breeched. If it is determined that the decay profile is not consistent with the crankcase being breeched, then the method returns. Otherwise, the method continues to 76, and then to 78.

It will be understood that the example control and estimation routines disclosed herein may be used with various system configurations. These routines may represent one or more different processing strategies such as event-driven, interrupt-driven, multi-tasking, multi-threading, and the like. As such, the disclosed process steps (operations, functions, and/or acts) may represent code to be programmed into computer readable storage medium in a control system. It will be understood that some of the process steps described and/or illustrated herein may in some embodiments be omitted without departing from the scope of this disclosure. Likewise, the indicated sequence of the process steps may not always be required to achieve the intended results, but is provided for ease of illustration and description. One or more of the illustrated actions, functions, or operations may be performed repeatedly, depending on the particular strategy being used.

Finally, it will be understood that the systems and methods described herein are exemplary in nature, and that these specific embodiments or examples are not to be considered in a limiting sense, because numerous variations are contemplated. Accordingly, the present disclosure includes all novel and non-obvious combinations and sub-combinations of the various systems and methods disclosed herein, as well as any and all equivalents thereof.

The invention claimed is:

1. A method for indicating whether a crankcase of an engine system is breeched, the engine system comprising an electronic control unit and a positive crankcase ventilation (PCV) system, the method comprising:

sensing an alternating component and a steady state component of crankcase pressure; and if an amplitude of an oscillation of the alternating component of crankcase pressure correlated to an operational state of an engine cylinder or a turbocharger is below a threshold, indicating that the crankcase is breeched and initiating a mitigating action.

2. The method of claim 1, wherein the mitigating action comprises one or more of reducing an intake of air into an engine, limiting a torque of the engine, limiting a fuel injection amount supplied to the engine, limiting a throttle opening, and disabling a turbocharger.

3. The method of claim 1, wherein the mitigation action includes adding lubricant to the crankcase by pumping lubricant from an auxiliary reservoir and into the crankcase.

4. The method of claim 1, further comprising sensing a phase locked sub-component of the alternating component of the crankcase pressure comprising synchronizing a sampling of the crankcase pressure to an operational state of the engine system.

5. The method of claim 1, further comprising adjusting restriction of a communication of a valve cover of the crankcase with atmosphere prior to sensing crankcase pressure.

6. The method of claim 5, wherein a restrictedness of a conduit is responsive to a pressure measured at a pulsation sensor on a breather valve.

7. The method of claim 1, further comprising sensing an additional component of crankcase pressure and the additional component is one of a low-pass filtered pressure, a Fourier component, or a sub-component of the alternating output locked in phase with an operating condition of an engine.

8. The method of claim 1, wherein the threshold depends on characteristics of one or more flow-control elements provided in the PCV system.

9. The method of claim 1, further comprising determining a size of a breech based on an amplitude of an oscillation of the alternating component of crankcase pressure.

10. An engine system having a crankcase and configured to indicate whether the crankcase is breeched, the engine system comprising:

a sensor having an alternating output responsive to a crankcase pressure;

a check valve disposed in a breather conduit; and an electronic control unit configured to sample the alternating output and to indicate that the crankcase is breeched if one or more oscillations of the alternating output correlated to an operational state of the engine more closely matches an output expected for a breeched crankcase than an output expected for an unbreeched crankcase, the crankcase communicating with atmosphere via the breather conduit connected to a valve cover, adjusting a restrictedness of the breather conduit responsive to one or more of the crankcase pressure and a signal from the electronic control unit.

11. The engine system of claim 10, wherein the electronic control unit is configured to determine a size of a breech based on one or more oscillations of the alternating output correlated to an operational state of the engine.

12. The engine system of claim 11, wherein the restrictedness of the breather conduit is controlled by a breather valve comprised of two check valves.

13. The engine system of claim 11, wherein the alternating output is filtered and indicating a breech when the filtered alternating output exceeds one or more of two thresholds.

* * * * *